US008547104B2

(12) United States Patent
Barrett

(10) Patent No.: US 8,547,104 B2
(45) Date of Patent: Oct. 1, 2013

(54) SELF POWER FOR IGNITION COIL WITH INTEGRATED ION SENSE CIRCUITRY

(75) Inventor: Jeffrey B. Barrett, Bolton, MA (US)

(73) Assignee: Woodward, Inc., Fort Collins, CO (US)

( * ) Notice: Subject to any disclaimer, the term of this patent is extended or adjusted under 35 U.S.C. 154(b) by 653 days.

(21) Appl. No.: 12/714,887

(22) Filed: Mar. 1, 2010

(65) Prior Publication Data

US 2011/0210745 A1 Sep. 1, 2011

(51) Int. Cl.
*F02P 17/00* (2006.01)

(52) U.S. Cl.
USPC ..... 324/388; 123/406.14; 123/406.26; 123/406.29; 123/435; 123/644; 701/111

(58) Field of Classification Search
USPC ..... 324/388
See application file for complete search history.

(56) References Cited

U.S. PATENT DOCUMENTS 3,937,200 A * 2/1976 Sleder et al. ..... 123/406.57
5,087,882 A * 2/1992 Iwata ..... 324/388
5,907,243 A * 5/1999 Goras et al. ..... 324/388
6,011,397 A * 1/2000 Yasuda ..... 324/388
6,075,366 A * 6/2000 Yasuda ..... 324/380
6,186,129 B1 * 2/2001 Butler, Jr. ..... 123/620
6,222,368 B1 * 4/2001 Inagaki et al. ..... 324/399
6,653,840 B2 * 11/2003 Yorita et al. ..... 324/380
6,653,841 B1 * 11/2003 Koerdt et al. ..... 324/445
6,715,340 B2 * 4/2004 Yamada et al. ..... 73/35.08
7,164,271 B2 * 1/2007 Ando ..... 324/380
7,730,880 B1 * 6/2010 Nagai et al. ..... 123/620
7,746,079 B2 * 6/2010 Fukumura et al. ..... 324/393
7,798,125 B2 * 9/2010 Barrett et al. ..... 123/406.37
2001/0052336 A1 * 12/2001 Tanaya et al. ..... 123/406.29
2002/0033041 A1 * 3/2002 Yamada et al. ..... 73/35.01
2003/0164164 A1 * 9/2003 Butler, Jr. ..... 123/606
2004/0007222 A1 * 1/2004 Skinner et al. ..... 123/609
2004/0085069 A1 * 5/2004 Zhu et al. ..... 324/388
2009/0183719 A1 * 7/2009 Aida et al. ..... 123/644
2009/0229569 A1 * 9/2009 Glugla et al. ..... 123/406.2

* cited by examiner

*Primary Examiner* — Melissa Koval
*Assistant Examiner* — Benjamin M Baldridge
(74) *Attorney, Agent, or Firm* — Reinhart Boerner Van Deuren P.C.

(57) ABSTRACT

A self power circuit for ion sense circuitry is provided. The self power circuit is configured to supply the voltages required to generate and measure an ion current flow in a combustion chamber of an engine. The power circuit stores power from the current flow in the ignition coil secondary circuit during at least a portion of a sparking period for use during the ion current measurement period between sparking events. Ion current generation voltage as well as positive and negative sensor circuit power supply voltages are generated in one embodiment.

28 Claims, 2 Drawing Sheets

SELF POWER FOR IGNITION COIL WITH INTEGRATED ION SENSE CIRCUITRY

FIELD OF THE INVENTION

This invention generally relates to power circuits for ion sense circuitry, and more particularly to power circuits for integrated ion sense and signal processing circuitry integrated with ignition coils.

BACKGROUND OF THE INVENTION

In the past it was difficult to determine the performance characteristics of an engine due to the fact that it was difficult to determine what was taking place in the combustion chamber of the engine. With the advent of ion sensing came the ability to determine the characteristics of the combustion within a combustion chamber, allowing one to determine whether a fuel mixture was, for example, too rich or too lean or whether knocking or good combustion was taking place.

Ion sensing relies on the fact that combustion in an engine creates measurable ionized gas. In such an engine an ion sensor may be installed or, with proper circuitry, the ignition spark plug or ignition coil may be used to sense ion current without installing additional sensors. The ion sensor detects a small current that flows through the ionized gas in the combustion chamber, and amplifier circuitry is used to allow analysis of the combustion ion signal to diagnose engine performance characteristics.

To provide enhanced analysis of the ion current signal, electronics are being integrated into ion sensing ignition coils for amplifying the small ion current signal and transmitting a high level analog signal to the Engine Control Unit (ECU) or other engine monitoring systems. Indeed, one such system is disclosed in co-pending application Ser. No. 12/714,975, filed on even date herewith, entitled Automatic Variable Gain Amplifier and assigned to the assignee of the instant application, the teachings and disclosure of which are hereby incorporated in their entireties by reference thereto.

One problem that has become apparent in ion sensing, however, relates to powering both the ion sensor, be it the ignition coil (spark plug) or a separate sensor, and the amplifying or signal processing electronics used therewith. In order to generate an ion current, the circuit requires a high voltage bias supply, in the range of 200 to 400 volts DC. The electronics used to amplify this ion signal also requires power, typically +/−5 Vdc.

In order to supply this power to these circuits, additional wires must be included in the system wiring harness. Such additional wires add to the overall cost and complexity of the system and the coil circuitry. Supplying this voltage to the ion sensing ignition coils though requires careful attention to ground loops and wire routing. Additionally, an Electromagnetic Interference (EMI) filter must be present inside each coil to filter any EMI that may be picked up by the system harness. Moreover, the typical voltage available in an engine system is 12 to 24 volts DC.

Further, generating the 200 to 400 volt bias required for the ion current generation is difficult. In the past, the bias would have been created using a flyback DC to DC converter containing a step up transformer. Because the bias current requirements are very low, the DC-DC converter could be small and contained in each coil. However, since the coils operate on the engine, their normal operating temperature is in the range of 90 to 100° C. Transformers of the typical DC-DC converter grade ferrites cannot operate at these high temperatures. Thus, higher cost ferrites, able to operate under the high temperature conditions, would need to be used, but this would drive up cost. Alternatively, the system could utilize a larger single DC-DC converter mounted off the engine to supply voltage to each coil, however this would require additional system harness wiring, again driving up cost and complexity. Moreover, the designer would be required to be cautious so as not to create ground loops, and isolation amplifiers would most likely be required. This, again, would increase cost and complexity.

Therefore, it would be advantageous to provide a system to supply the voltages required by the ion sensing ignition coils and electronics without adding the complexity and cost of additional wiring, high cost DC-DC ferrites, or a DC-DC converter mounted off of the engine. Additionally, it would be advantageous to provide an ignition system with ion sensing ignition coils that does not require EMI filters in the coils and eliminates the risk and complexity associated with possible ground loops created by the harness. Moreover, it would be advantageous to provide ion sensing ignition coil circuitry that is simple, small in size, operable at the high engine temperature.

Embodiments of the present invention provide such a system that provides one or more of the above advantages. These and other advantages of the invention, as well as additional inventive features, will be apparent from the description of the invention provided herein.

BRIEF SUMMARY OF THE INVENTION

In view of the above, embodiments of the present invention provide new and improved power supply for ion current sensing circuitry that overcome one or more of the problems existing in the art. More particularly, embodiments of the present invention provide a new and improved power supply for ion current sensing circuitry including ion current sensors and/or use of ignition coils (spark plugs), and amplification or signal processing circuitry that overcome one or more of the problems existing in the art.

In one embodiment, the AC current of the ignition system is rectified during a sparking event and stored in a capacitor to provide the bias voltage required for ion sensing. The ignition current is also rectified and stored on capacitors to power the ion current amplification circuitry. In preferred embodiments, such a power supply is very simple, small in size, utilizes primarily diodes and capacitors, and is able to operate at the high engine temperatures, thus eliminating the need for more expensive ferrites or a separate converter mounted off the engine to supply power to each sensor and to the electronics.

In one embodiment, the power supply utilizes the AC ion sensing ignition coil power during the sparking event for the sparking duration to generate the necessary power to generate the ion current during the combustion event and to power the electronics associated with amplification thereof.

In one aspect, certain embodiment of the present invention provides an ion sensing power supply system to supply the voltages required by the ion sensors or ignition coils used as an ion current sensor without adding the complexity and cost of additional wiring, high cost DC-DC ferrites, or a DC-DC converter mounted off of the engine. In another aspect, certain embodiments eliminate the need for EMI filters in the coils and reduces or eliminates the risk associated with possible ground loops created by wiring that otherwise would be needed in the harness.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
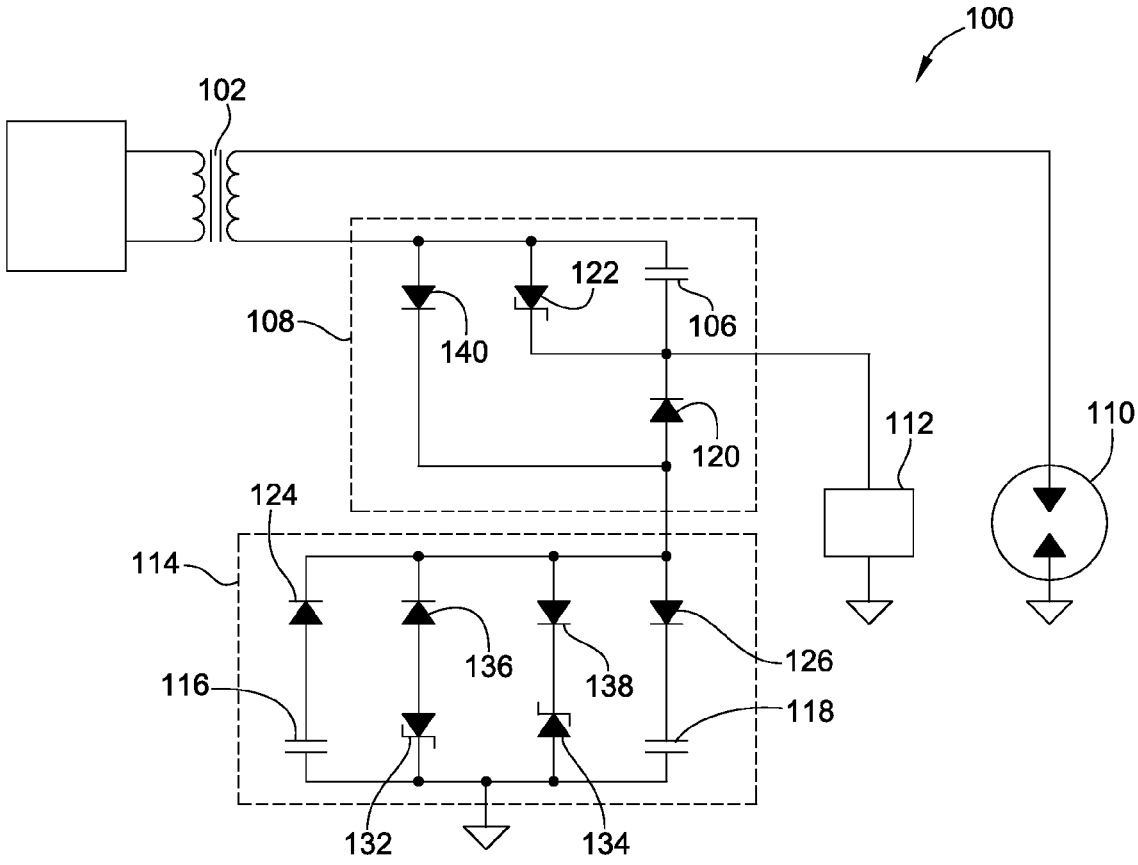
FIG. 1 is a simplified schematic circuit diagram showing an embodiment of a power supply circuit constructed in accordance with the teachings of the present invention for supplying power to an ion sensor and to associated amplification circuitry.

Turning now to the Drawings, there is illustrated in FIG. 1 a simplified circuit schematic of a power circuit for an ion sensor, such as an ignition coil of an internal combustion engine used to sense ion current in the combustion chamber thereof. However, while the following description will utilize such an exemplary environment in describing various features and functionality of embodiments of the present invention, such description should be taken by way of a simplified computer-simulated example and not by way of limitation. Further clarifying comments will also be included based on testing of prototype circuits where appropriate.

As illustrated in FIG. 1, the self power circuit 100 for powering the ion sense circuitry utilizes the AC current flow in the secondary winding of the ignition coil secondary circuit 102 during the sparking event, i.e. when the ignition spark is being delivered to the combustion chamber of the engine. As discussed above, following the sparking ignition event, the ion sensing circuitry will require a large bias voltage of between 200-400 Vdc to generate and measure the ion current flowing across the spark gap 110 of the spark plug used to sense ion current flow in this exemplary embodiment. As illustrated in FIG. 1, element 112 is the ion sense resistor used by the ion sensing circuit (not shown) to measure this ion current. To provide the required bias voltage, an embodiment of the present invention includes the bias supply circuit 108 to be discussed in greater detail below.

In embodiments that utilize on-engine electronics, such as the variable gain amplifier discusses in the above identified co-pending application, or a low power micro-processor used to process the ion current signal, a sensor circuit power supply of +/−5 Vdc is also provided. To self generate this power requirement the illustrated embodiment includes the sensor power circuit 114 to be discussed in greater detail below.

Figure 2:
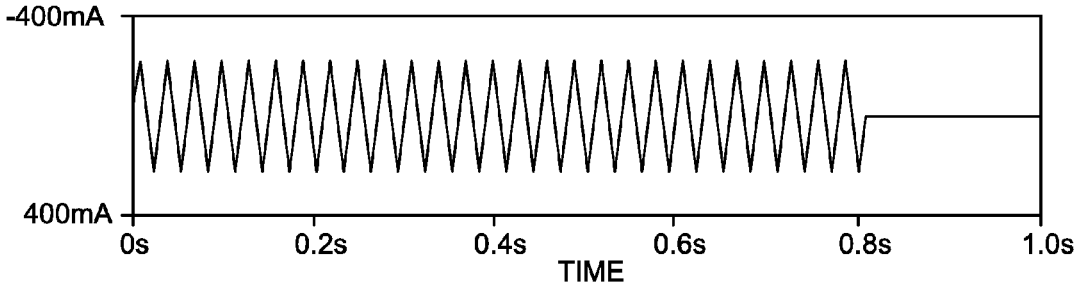
FIG. 2 is a graphical illustration of a AC current source output.
Figure 3:
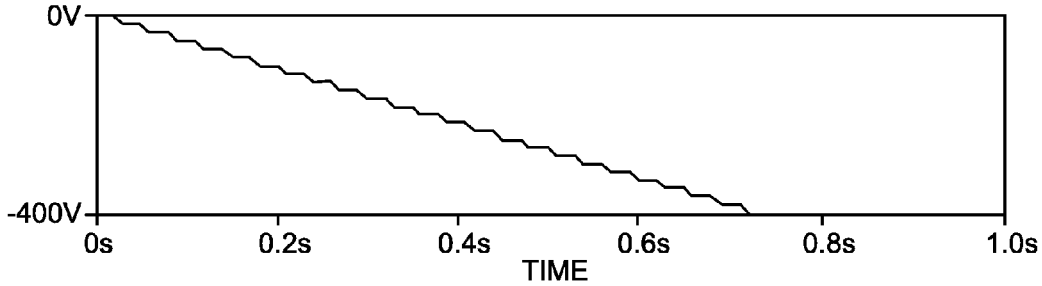
FIG. 3 is a graphical illustration of a charge on a bias supply/charging circuit capacitor.

During the sparking event, which is programmable and may be, e.g., of only 800 microsecond duration, the negative half cycle of AC current flow (see FIG. 2 for an illustration of the AC current flow) in the ignition coil secondary circuit 102 charges a bias supply capacitor 106 through diode 120 of the bias supply circuit 108 to a higher and higher (negative) voltage as shown in FIG. 3. Once the bias voltage stored on the bias supply capacitor 106 reaches, e.g., 400 Vdc, zener diode 122 will conduct to clamp the voltage and prevent overcharging. As shown in FIG. 3, this clamp voltage is reached in approximately 700 microseconds. In addition zener diode 122 bypasses the bias capacitor 106 such that all additional ignition coil current flow beyond that required to fully charge the bias supply capacitor 106 will be bypassed by the clamping zener diode 122 and will be delivered to the spark gap 110 and to the sensor power circuit 114. Similarly, during the opposite polarity of the ignition coil current flow diode 140 bypasses all current flow to the spark gap 110 and sensor power circuit 114, and thus the charge on bias supply capacitor 106 remains unchanged during this half-cycle.

Once the sparking period has ended, the bias supply capacitor 106 will be fully charged and ready to supply the large bias voltage required by the ion sense circuitry to generate the ion current across the spark gap 110 and sense its flow via resistor 112. During each subsequent sparking event, the AC current flow in the ignition coil secondary circuit 102 will again fully charge the bias supply capacitor 106 through diode 120 to the clamping voltage dictated by zener diode 122.

As introduced above and as described in detail in the above identified co-pending application, the ion sensing circuitry that analyzes the ion current flow may include an amplifier to selectively amplify the ion signal sensed across resistor 112 for use by an ECU. In such systems, power for the amplification circuitry can be self generated by the sensor power circuit 114 illustrated in FIG. 1. In the illustrated embodiment and of particular use in systems requiring both positive and negative power supplies, e.g. for use with operational amplifiers, the sensor power circuit 114 includes a first and a second power circuit capacitor 116, 118 coupled through steering rectifier diodes 124, 126, respectively. The charging of the power circuit capacitors 116, 118 occurs during opposite half cycles of the bi-directional current flow in the ignition coil secondary circuit 102 during the sparking event, through their respective diodes 124, 126. The zener diodes 132, 134 and corresponding series diodes 136, 138 are configured to clamp each polarity of voltages on the sensor power circuit capacitors 116, 118 to the desired maximum. In addition the zener and diode clamps bypass the power circuit capacitors 116 and 118 such that all additional ignition coil current flow beyond that required to fully charge the power circuit capacitors will be bypassed by the clamping zener and delivered to the spark gap and to the bias supply circuit.

Figure 4:
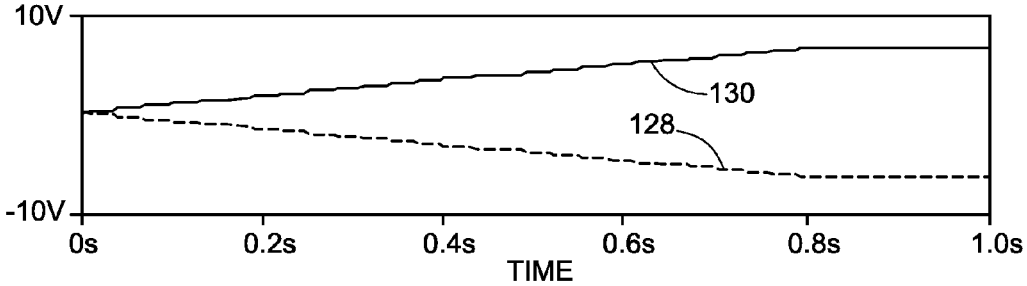
FIG. 4 is a graphical illustration of charges on two circuit power supply circuit capacitors.

This charging cycle is shown by the two waveforms 128, 130 of FIG. 4. Once the sparking period has ended, the first and second power circuit capacitors 116, 118 are fully charged and are used to power the ion sense amplification circuitry. During each subsequent sparking event, the AC current flow in the ignition coil secondary circuit 102 again begins a new cycle of sparking time, the AC current flow in the ignition coil secondary circuit 102 recharges the first and second power circuit capacitors 116, 118.

In the example simulation particularly suited to generate a 400 Vdc bias voltage and +/−5 Vdc sensor supply voltages during an 800 microsecond sparking event having a minimum triangular AC spark current of approximately 130 milliamperes RMS, the bias supply capacitor 106 is sized at approximately 0.1 μF, while the first and second power circuit capacitors 116, 118 are sized at approximately 5 μF. These small values of capacitance allowed the simulation to show full recharging from an initial condition of zero volts on all capacitors in 800 microseconds or less. Since the AC current flow for the spark generation is current limited by the ignition system, the charging rate of the capacitors 106, 116, 118 is determined by their size. A larger capacitor will charge more slowly, but its voltage will also droop less between recharging sparking events. As such, the capacitors 106, 116, 118 may be sized to provide balance between charge during the duration of the sparking event and droop during the ion measurement event As long as the charge delivered to the capacitors during the spark event is greater than the charge depleted during the ion measurement event, the capacitor voltages will remain in a safe operating area. However, if the charge depleted during the ion measurement event exceeds the charge delivered to the capacitors during the spark event, the capacitor voltages will eventually decrease to near zero and the circuits will cease to operate. Testing of a prototype system showed that it is not necessary to completely recharge the capacitors from zero charge on every spark event, and that on startup several spark events may be required to charge the capacitors sufficiently to be in an acceptable operating voltage range. For prototype testing capacitor 106 was 0.268 μF, and capacitors 116 and 118 were 100 μF. Also, note that as engine RPM increases the recharging spark events occur more frequently and there is therefore more charge available to be depleted by the ion bias and sensor circuits.

In another embodiment with an AC ignition coil diodes 120, 140, and zener 122 can be reversed in polarity to generate positive bias voltage rather than the aforementioned negative bias voltage. In still further embodiments the self power circuit for bias generation or sensor power can be used with either CD (capacitor discharge) or inductive ignition coils, with the limitation that the bias polarity and sensor power polarity options are limited by the unipolar direction of the spark current flow. Furthermore, CD or inductive ignition coils with a negative spark current polarity i.e. current flowing from the ground electrode of the spark gap to the high voltage electrode of the spark gap, can only produce positive bias supply and sensor supply voltages. Inversely, CD or inductive ignition coils with a positive spark current polarity i.e. current flowing from the high voltage electrode of the spark gap to the ground electrode of the spark gap, can only produce negative bias supply and sensor supply voltages.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A self power circuit for generating a bias voltage to enable an ion sensor to generate an ion current flow in a combustion chamber of an engine after a spark has been generated by bi-directional AC current flow from a secondary winding of an AC ignition coil, the self power circuit comprising a bias supply circuit having only passive electrical components and having a series connected bias supply capacitor and diode coupled in series with the ignition coil and a spark plug, the diode oriented to allow current flow through the bias supply capacitor to increase a charge stored thereon during a half cycle of the bi-directional AC current flow from the ignition coil to the spark plug during the generation of the spark, the bias supply capacitor coupled to the ion sensor at a first node to supply the bias voltage thereto from the charge stored thereon to generate the ion current flow.

2. The self power circuit of claim 1, wherein the bias supply circuit includes a zener diode coupled in parallel with the series connected bias supply capacitor to limit the charge stored on the bias supply capacitor.

3. The self power circuit of claim 2, wherein the zener diode is a 400 Vdc zener diode.

4. The self power circuit of claim 1, further comprising a second diode coupled in anti-parallel arrangement to the bias supply capacitor and diode.

5. The self power circuit of claim 1, wherein the ion sensor includes the spark plug and a series connected ion sense resistor.

6. The self power circuit of claim 5, wherein the spark plug and the series connected ion sense resistor are coupled in parallel with the bias supply capacitor.

7. The self power circuit of claim 1, wherein the bi-directional AC current flow from the AC ignition coil is limited to a predetermined duration, and wherein the bias supply capacitor is sized so as to ensure that the charge stored thereon reaches a predetermined bias voltage during the predetermined duration of the bi-directional AC current flow from the AC ignition coil.

8. The self power circuit of claim 7, wherein the bi-directional AC current flow from the ignition coil is limited to 800 microseconds, and wherein the bias supply capacitor is sized at 0.1 μF so as to ensure that the charge stored thereon reaches 400 Vdc during the AC Current flow from the AC ignition coil.

9. A self power circuit for generating a bias voltage to enable an ion sensor to generate an ion current flow in a combustion chamber of an engine after a spark has been generated by bi-directional AC current flow from a secondary winding of an AC ignition coil, the self power circuit comprising a bias supply circuit having only passive electrical components and having a series connected bias supply capacitor and diode coupled in series with the ignition coil and a spark plug, the diode oriented to allow current flow through the bias supply capacitor to increase a charge stored thereon during a half cycle of the bi-directional AC current flow from the ignition coil to the spark plug during the generation of the spark, the bias supply capacitor coupled to the ion sensor at a first node to supply the bias voltage thereto from the charge stored thereon to generate the ion current flow; and further comprising a sensor power circuit coupled in series with the bias supply circuit, the sensor power circuit including a first and a second power circuit capacitor coupled through anti-parallel diodes, respectively, oriented to allow current flow through the first and the second power circuit capacitors during opposite half cycles of the bi-directional AC current flow from the AC ignition coil during the generation of the spark to increase a first charge stored on the first power circuit capacitor and to increase a second charge stored on the second power circuit capacitor, the first charge and the second charge being opposite in polarity.

10. The self power circuit of claim 9, further comprising a pair of anti-parallel zener diodes coupled in parallel to the first and the second power circuit capacitors.

11. The self power circuit of claim 10, wherein each of the pair of anti-parallel zener diodes includes a series connected diode.

12. The self power circuit of claim 10, wherein the anti-parallel zener diodes are each 5 Vdc zener diodes.

13. The self power circuit of claim 9, wherein the AC current flow from the ignition coil is limited to a predetermined duration, and wherein the bias supply capacitor is sized so as to ensure that the charge stored thereon reaches a predetermined bias voltage during the duration of bi-directional AC current flow from the AC ignition coil, and wherein the first and the second power circuit capacitors are sized so as to ensure that the first and the second charge stored thereon reaches a predetermined voltage during the duration of bi-directional AC current flow from the AC ignition coil.

14. The self power circuit of claim 13, wherein the bi-directional AC current flow from the ignition coil is limited to 800 microseconds, and wherein the bias supply capacitor is sized at 0.1 μF so as to ensure that the charge stored thereon reaches 400 Vdc during the bi-directional AC current flow from the AC ignition coil, and wherein the first and the second power circuit capacitors are sized at 5 μF so as to ensure that the first and the second charge stored thereon reaches approximately 5 Vdc during the bi-directional AC current flow from the AC ignition coil.

15. An ion current generation circuit, comprising: an ignition coil configured to generate a spark current for a spark duration;

a spark plug coupled in series to a secondary winding of the ignition coil for generating a spark across a spark gap in a combustion chamber of an engine to cause an ignition event therein;

a self-power circuit having only passive electrical components, coupled in series with the secondary winding of the ignition coil and the spark plug for generating a bias voltage during the ignition event to enable an ion current flow across the spark gap in the combustion chamber of the engine immediately following the ignition event, the self power circuit comprising a bias supply circuit having a series connected bias supply capacitor and diode, the diode oriented to allow current flow through the bias supply capacitor to increase a charge stored thereon during a half cycle of the AC current flow from the ignition coil to the spark plug during the spark duration; and wherein the bias supply capacitor automatically discharges across the spark gap to cause the ion current flow immediately following the ignition event.

16. The ion current generation circuit of claim 15, further comprising an ion sense resistor coupled in circuit between the bias supply capacitor and the spark plug so as to generate an ion current voltage signal representative of the ion current flow.

17. The ion current generation circuit of claim 15, wherein the bias supply circuit includes a zener diode coupled in parallel with the bias supply capacitor to limit the charge stored thereon.

18. An ion current generation circuit, comprising; an ignition coil configured to generate a spark current for a spark duration;

a spark plug coupled in series to a secondary winding of the ignition coil for generating a spark across a spark gap in a combustion chamber of an engine to cause an ignition event therein;

a self-power circuit, having only a passive electrical components, coupled in series with a secondary winding of the ignition coil and the spark plug for generating a bias voltage during the ignition event to enable an ion current flow across the spark gap in the combustion chamber of the engine immediately following the ignition event, the self power circuit comprising a bias supply circuit having a series connected bias supply capacitor and diode, the diode oriented to allow current flow through the bias supply capacitor to increase a charge stored thereon during a half cycle of the AC current flow from the ignition coil to the spark plug during the spark duration; and wherein the bias supply capacitor automatically discharges across the spark gap to cause the ion current flow immediately following the ignition event; and further comprising a sensor power circuit coupled in series with the bias supply circuit, the sensor power circuit including a first power circuit capacitor coupled in series with a first power circuit diode oriented to allow current flow through the power circuit capacitor during a first half cycle of the AC current flow from the ignition coil during the spark duration to increase a charge stored thereon.

19. The ion current generation circuit of claim 18, wherein the sensor power circuit further includes a second power circuit capacitor coupled in series with a second power circuit diode oriented to allow current flow through the power circuit capacitor during a second half cycle of the AC current flow from the ignition coil during the spark duration to increase a charge stored thereon, the second power circuit capacitor and series connected second power circuit diode being coupled in parallel to the first power circuit capacitor and first power circuit diode.

20. The ion current generation circuit of claim 19, wherein the first power circuit diode and the second power circuit diode are oriented such that the first half cycle is a positive half cycle and the second half cycle is a negative half cycle.

21. The ion current generation circuit of claim 19, wherein the sensor power circuit further includes a pair of zener diodes coupled in parallel to the first and the second power circuit capacitors.

22. A sensor power circuit for generating a control voltage for an ion current sensing system after a spark has been generated by bi-directional AC current flow from a secondary winding of an AC ignition coil for an engine, comprising a first and a second power circuit capacitor coupled through anti-parallel diodes, respectively, oriented to allow a capacitor-charging current flow through the first and the second power circuit capacitors during opposite half cycles of the bi-directional AC current flow from the secondary winding of the AC ignition coil during the generation of the spark to increase a first charge stored on the first power circuit capacitor and to increase a second charge stored on the second power circuit capacitor, the first charge and the second charge being opposite in polarity.

23. The sensor power circuit of claim 22, further comprising a pair of zener diodes coupled in parallel to the first and the second power circuit capacitors.

24. The sensor power circuit of claim 23, wherein each of the zener diodes includes a series connected diode.

25. The sensor power circuit of claim 23, wherein the zener diodes are each 5 Vdc zener diodes.

26. The sensor power circuit of claim 22, wherein the first and second power circuit capacitors are configured to supply a constant voltage after spark generation.

27. The sensor power circuit of claim 26, wherein the first and second power circuit capacitors supply both a positive voltage and a negative voltage.

28. The sensor power circuit of claim 26, wherein the first and second power circuit capacitors supply, to an ion current sensing circuit, a positive voltage of approximately five volts and a negative voltage of approximately negative five volts.

* * * * *

UNITED STATES PATENT AND TRADEMARK OFFICE

CERTIFICATE OF CORRECTION

PATENT NO. : 8,547,104 B2
APPLICATION NO. : 12/714887
DATED : October 1, 2013
INVENTOR(S) : Jeffrey B. Barrett It is certified that error appears in the above-identified patent and that said Letters Patent is hereby corrected as shown below:

In the Claims:

Claim 14
Column 7, Line 46 delete the word "approximately"

Signed and Sealed this
Seventeenth Day of December, 2013

Margaret A. Focarino

Margaret A. Focarino
*Commissioner for Patents of the United States Patent and Trademark Office*